US011668501B2

(12) United States Patent
Cho et al.

(10) Patent No.: US 11,668,501 B2
(45) Date of Patent: Jun. 6, 2023

(54) AIR CONDITIONER

(71) Applicant: LG ELECTRONICS INC., Seoul (KR)

(72) Inventors: Eunjun Cho, Seoul (KR); Pilhyun Yoon, Seoul (KR); Seongho Hong, Seoul (KR); Jungmin Park, Seoul (KR); Yejin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 52 days.

(21) Appl. No.: 17/336,510

(22) Filed: Jun. 2, 2021

(65) Prior Publication Data

US 2021/0389032 A1 Dec. 16, 2021

(30) Foreign Application Priority Data

Jun. 16, 2020 (KR) ..... 10-2020-0073100

(51) Int. Cl.
*F25B 43/00* (2006.01)
*F25B 41/31* (2021.01)
(Continued)

(52) U.S. Cl.
CPC ..... *F25B 43/00* (2013.01); *F25B 39/00* (2013.01); *F25B 41/31* (2021.01); *F25B 41/40* (2021.01); *F25B 2400/23* (2013.01)

(58) Field of Classification Search
CPC ..... F25B 43/00; F25B 41/31; F25B 41/40; F25B 39/00; F25B 2400/23
(Continued)

(56) References Cited

U.S. PATENT DOCUMENTS

2020/0166258 A1* 5/2020 Wang ..... F25B 43/02

FOREIGN PATENT DOCUMENTS

CN 102788458 11/2012
CN 106369864 2/2017
(Continued)

OTHER PUBLICATIONS

Attached pdf file is translation of foreign reference CN 106369864 A (Year: 2017).*

(Continued)

*Primary Examiner* — Henry T Crenshaw
*Assistant Examiner* — Kamran Tavakoldavani
(74) *Attorney, Agent, or Firm* — Ked & Associates

(57) ABSTRACT

An air conditioner may include a compressor that compresses a refrigerant; a condenser that condenses the refrigerant discharged from the compressor; at least one expansion valve that expands the refrigerant passed through the condenser; at least one gas-liquid separation pipe through which the refrigerant passed through the at least one expansion valve flows; a gas-liquid separator, into which the refrigerant passed through the at least one gas-liquid separation pipe is introduced, that separates and discharges the refrigerant introduced into the gas-liquid separator into gas refrigerant and liquid refrigerant; and an evaporator that evaporates the liquid refrigerant discharged from the gas-liquid separator. The gas refrigerant discharged from the gas-liquid separator and the refrigerant passed through the evaporator may be provided to the compressor.

18 Claims, 12 Drawing Sheets

(51) Int. Cl.
*F25B 41/40* (2021.01)
*F25B 39/00* (2006.01)

(58) Field of Classification Search
USPC ..... 62/503
See application file for complete search history.

(56) References Cited

FOREIGN PATENT DOCUMENTS

| | | | |
|---|---|---|---|
| CN | 106369864 A | * | 2/2017 |
| EP | 2690376 | | 1/2014 |
| JP | 2000-320933 | | 11/2000 |
| JP | 2013-139894 | | 7/2013 |
| KR | 10-2013-0140469 | | 12/2013 |
| KR | 10-2018-0104416 | | 9/2018 |
| WO | WO 00/11418 | | 3/2000 |
| WO | WO 2008/152760 | | 12/2008 |

OTHER PUBLICATIONS

Pdf is translation of foreign reference CN-106369864-A (Year: 2017).*
European Search Report dated Oct. 29, 2021 issued in Application No. 21178113.3.
Chinese Office Action dated Aug. 16, 2022 issued in Application No. 202110623739.8.

* cited by examiner

AIR CONDITIONER

CROSS-REFERENCE TO RELATED APPLICATION(S)

This application claims the priority benefit of Korean Patent Application No. 10-2020-0073100, filed on Jun. 16, 2020, the disclosure of which is incorporated herein by reference in its entirety.

BACKGROUND

1. Field

An air conditioner is disclosed herein.

2. Background

In general, an air conditioner refers to an apparatus that cools and heats a room through compression, condensation, expansion and evaporation processes of refrigerant. If an outdoor heat exchanger of the air conditioner serves as a condenser, whereas an indoor heat exchanger serves as an evaporator, the room may be cooled. On the other hand, if the outdoor heat exchanger of the air conditioner serves as an evaporator, whereas the indoor heat exchanger serves as a condenser, the room may be heated.

A conventional air conditioner includes a gas-liquid separator that receives a refrigerant that has passed through an expansion valve and separates and discharges the received refrigerant into gas refrigerant and liquid refrigerant. In this case, the gas refrigerant separated in the gas-liquid separator is injected into a compressor, and the liquid refrigerant separated in the gas-liquid separator may be supplied to an evaporator.

However, if the gas refrigerant and the liquid refrigerant are not sufficiently separated in the gas-liquid separator, there is a problem in that the liquid refrigerant is injected into the compressor, causing damage to the compressor. Recently, a lot of research has been conducted on a method for increasing a separation rate of gas refrigerant and liquid refrigerant in a gas-liquid separator.

BRIEF DESCRIPTION OF THE DRAWINGS

Embodiments will be described in detail with reference to the following drawings in which like reference numerals refer to like elements, and wherein.

DETAILED DESCRIPTION

Description will now be given according to embodiments disclosed herein, with reference to the accompanying drawings. For the sake of brief description with reference to the drawings, the same or equivalent components may be denoted by the same reference numbers, and description thereof will not be repeated. In general, suffixes such as "module" and "unit" may be used to refer to elements or components. Use of such suffixes herein is merely intended to facilitate description of the specification, and the suffixes do not have any special meaning or function. In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, embodiments should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are only used to distinguish one element from another. It will be understood that when an element is referred to as being "connected with" another element, there may be intervening elements present. In contrast, it will be understood that when an element is referred to as being "directly connected with" another element, there are no intervening elements present. A singular representation may include a plural representation unless context clearly indicates otherwise. Terms such as "includes" or "has" used herein should be considered as indicating the presence of several components, functions or steps, disclosed in the specification, and it is also understood that more or fewer components, functions, or steps may likewise be utilized.

Figure 1:
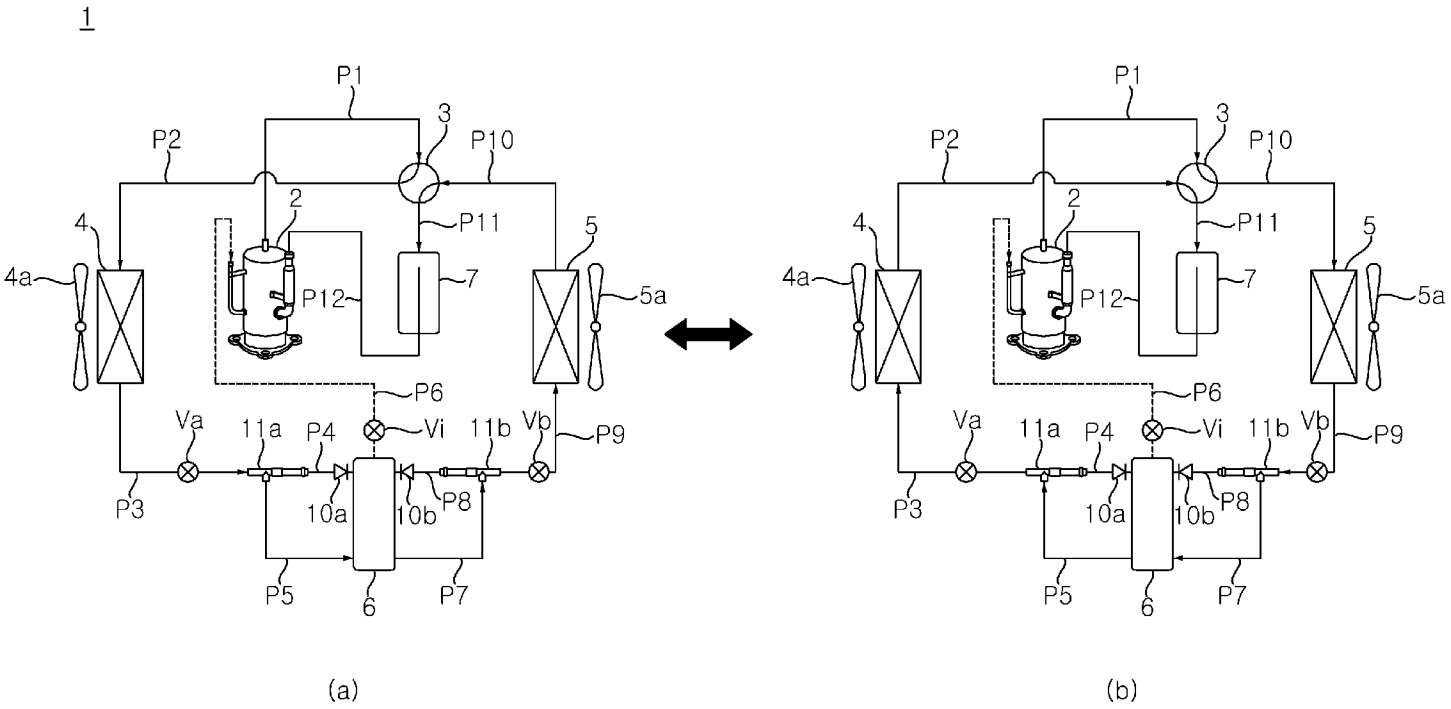
FIG. 1 is a schematic diagram of an air conditioner capable of switching between a cooling operation and a heating operation according to an embodiment and a flow of a refrigerant, and explains an embodiment in which a first gas-liquid separation pipe and a second gas-liquid separation pipe are provided and gas refrigerant separated by a gas-liquid separator is injected into a medium pressure stage of a compressor.

Referring to FIG. 1, an air conditioner 1 may include a compressor 2, a switching valve, an outdoor heat exchanger 4, an indoor heat exchanger 5, expansion valves Va and Vb, a gas-liquid separator 6, gas-liquid separation pipes 11*a* and 11*b*, and a plurality of pipes P (P1 to P12). The expansion valve may include first expansion valve Va and second expansion valve Vb. The gas-liquid separation pipes may include first gas-liquid separation pipe 11*a* and second gas-liquid separation pipe 11*b*.

The compressor 2 may compress the refrigerant introduced from an accumulator 7 and discharge a high-temperature and high-pressure refrigerant. A first pipe P1 may be installed between the compressor 2 and the switching valve 3 to provide a flow path for refrigerant from the compressor 2 to the switching valve 3. The accumulator 7 may provide a gas refrigerant to the compressor 2 through a twelfth pipe P12.

The switching valve 3 may receive a refrigerant which is discharged from the compressor 2 and passed through the first pipe P1. In addition, the switching valve 3 may guide the refrigerant introduced through the first pipe P1 to the outdoor heat exchanger 4 or the indoor heat exchanger 5. For example, the switching valve 3 may be a four-way valve. An eleventh pipe P11 may be installed between the switching valve 3 and the accumulator 7 to provide a flow path for a refrigerant from the switching valve 3 to the accumulator 7.

The outdoor heat exchanger 4 may heat-exchange the refrigerant and outdoor air. A direction of heat transfer between the refrigerant and outdoor air in the outdoor heat exchanger 4 may differ depending on an operation mode of the air conditioner, that is, depending on whether it is a cooling operation mode or a heating operation mode. An outdoor fan 4*a* may be disposed at one side of the outdoor heat exchanger 4 to adjust an amount of air provided to the outdoor heat exchanger 4. For example, the outdoor fan 4*a* may be driven by an electric motor. A second pipe P2 may be installed between the switching valve 3 and the outdoor heat exchanger 4 to provide a flow path for refrigerant connecting the switching valve 3 and the outdoor heat exchanger 4.

The indoor heat exchanger 5 may heat-exchange the refrigerant and indoor air. A direction of heat transfer between the refrigerant and the indoor air in the indoor heat exchanger 5 may differ depending on the operation mode of the air conditioner, that is, depending on whether it is a cooling operation mode or a heating operation mode. An indoor fan 5*a* may be disposed at one side of the indoor heat exchanger 5 to adjust an amount of air provided to the indoor heat exchanger 5. For example, the indoor fan 5*a* may be driven by an electric motor. A tenth pipe P10 may be installed between the switching valve 3 and the indoor heat exchanger 5 to provide a flow path for refrigerant connecting the switching valve 3 and the indoor heat exchanger 5.

The first expansion valve Va and the second expansion valve Vb may be installed between the outdoor heat exchanger 4 and the indoor heat exchanger 5. That is, the first expansion valve Va may be installed in a third pipe P3 facing the second pipe P2 across the outdoor heat exchanger 4. In addition, the second expansion valve Vb may be installed in a ninth pipe P9 facing the tenth pipe P10 across the indoor heat exchanger 5. The first expansion valve Va and the second expansion valve Vb may expand the refrigerant supplied from one of the outdoor heat exchanger 4 or the indoor heat exchanger 5 according to the operation mode of the air conditioner.

The gas-liquid separator 6 may receive refrigerant expanded from the first expansion valve Va or the second expansion valve Vb. The gas-liquid separator 6 may separate the received refrigerant into gas refrigerant and liquid refrigerant. For example, the gas-liquid separator 6 may be formed in a cylindrical shape extending lengthwise in a vertical direction. In this case, the liquid refrigerant, among two-phase refrigerant expanded in the first expansion valve Va or the second expansion valve Vb and introduced into the gas-liquid separator 6, may flow to a lower portion of the gas-liquid separator 6, while the gas refrigerant may flow to an upper portion of the gas-liquid separator 6. The gas-liquid separator 6 may include a liquid refrigerant pipe, through which the liquid refrigerant may be discharged, that is, provided in the lower portion of the gas-liquid separator 6, and a gas refrigerant pipe, through which the gas refrigerant may be discharged, provided in the upper portion of the gas-liquid separator 6.

The first gas-liquid separation pipe 11*a* may be installed between the first expansion valve Va and the gas-liquid separator 6. In addition, the first gas-liquid separation pipe 11*a* may be connected to the first expansion valve Va through a third pipe P3, and connected to the gas-liquid separator 6 through a fourth pipe P4 and a fifth pipe P5. Depending on the operation mode of the air conditioner, the refrigerant may flow into the gas-liquid separator 6 through the fourth pipe P4 and the fifth pipe P5, or the liquid refrigerant may be discharged from the gas-liquid separator 6 through the fifth pipe P5.

The second gas-liquid separation pipe 11*b* may be installed between the second expansion valve Vb and the gas-liquid separator 6. In addition, the second gas-liquid separation pipe 11*b* may be connected to the second expansion valve Vb through a ninth pipe P9, and connected to the gas-liquid separator 6 through a seventh pipe P7 and an eighth pipe P8. Depending on the operation mode of the air conditioner, the refrigerant may flow into the gas-liquid separator 6 through the seventh pipe P7 and the eighth pipe P8, and the liquid refrigerant may be discharged from the gas-liquid separator 6 through the seventh pipe P7.

A sixth pipe P6 may provide a flow path for refrigerant connecting the gas-liquid separator 6 and the compressor 2 as a gas refrigerant pipe of the gas-liquid separator 6 described above. In this case, an injection valve Vi may be installed in the sixth pipe P6 to open and close the flow path.

Referring to the left drawing of FIG. 1, low-temperature and low-pressure refrigerant flowing from the accumulator 7 to the compressor 2 through the twelfth pipe P12 may be compressed in the compressor 2 and discharged in a high-temperature and high-pressure state. The refrigerant discharged from the compressor 2 may be introduced into the outdoor heat exchanger 4 through the first pipe P1, the switching valve 3, and the second pipe P2, sequentially.

As heat energy is transferred from the refrigerant to the outdoor air in the outdoor heat exchanger 4, the refrigerant may be condensed. At this time, the outdoor heat exchanger 4 may be referred to as a condenser. The refrigerant condensed while passing through the outdoor heat exchanger 4 may pass through the third pipe P3 and may be expanded in the first expansion valve Va up to a range corresponding to a medium pressure stage of the compressor 2. The medium pressure stage of the compressor 2 may be understood as a pressure formed between the pressure, that is, a low pressure, of refrigerant flowing into the compressor 2 and the pressure, that is, a high pressure, of refrigerant discharged from the compressor 2. For example, the first expansion valve Va may be an electronic expansion valve EEV capable of adjusting an opening degree of the flow path of the third pipe P3.

The refrigerant expanded in the first expansion valve Va may flow into the first gas-liquid separation pipe 11*a* in a two-phase state. A relatively large amount of gas refrigerant among the two-phase refrigerant introduced into the first gas-liquid separation pipe 11*a* may flow into the gas-liquid separator 6 through the fourth pipe P4, and a relatively large amount of liquid refrigerant may flow into the gas-liquid separator 6 through the fifth pipe P5, which will be described hereinafter.

The gas-liquid separator 6 may separate and discharge the two-phase refrigerant introduced into the gas-liquid separator 6 into gas refrigerant and liquid refrigerant. The gas refrigerant separated by the gas-liquid separator 6 may flow into the medium pressure stage of the compressor 2 through the sixth pipe P6. In this case, the injection valve Vi may be an EEV or a solenoid valve that opens and closes the sixth pipe P6. The liquid refrigerant separated by the gas-liquid separator 6 may flow into the second gas-liquid separation pipe 11*b* through the seventh pipe P7. The liquid refrigerant introduced into the second gas-liquid separation pipe 11*b* may pass through the ninth pipe P9 and may expand in the second expansion valve Vb up to a range corresponding to a low pressure stage of the compressor 2. For example, the second expansion valve Vb may be an electronic expansion valve EEV capable of adjusting an opening degree of the flow path of the ninth pipe P9. The refrigerant expanded in the second expansion valve Vb may be introduced into the indoor heat exchanger 5 through the ninth pipe P9.

As the heat energy of the indoor air is transferred from the indoor heat exchanger 5 to the refrigerant, the refrigerant may be evaporated. At this time, the indoor heat exchanger 5 may be referred to as an evaporator. Further, according to the heat exchange between the refrigerant and the indoor air, a temperature of the indoor air is lowered, so that the indoor space may be cooled. The refrigerant evaporated while passing through the indoor heat exchanger 5 may flow into the accumulator 7 through the tenth pipe P10, the switching valve 3, and the eleventh pipe P11, sequentially, so that a refrigerant cycle for the above-described cooling operation of the air conditioner may be completed.

Referring to the right drawing of FIG. 1, the low-temperature and low-pressure refrigerant flowing from the accumulator 7 to the compressor 2 through the twelfth pipe P12 may be compressed in the compressor 2 and discharged in a high-temperature and high-pressure state. The refrigerant discharged from the compressor 2 may be introduced into the indoor heat exchanger 5 through the first pipe P1, the switching valve 3, and the tenth pipe P10, sequentially.

As heat energy is transferred from the refrigerant to the indoor air in the indoor heat exchanger 5, the refrigerant may be condensed. At this time, the indoor heat exchanger 5 may be referred to as a condenser. In addition, according to the heat exchange between the refrigerant and the indoor air, the temperature of the indoor air may increase to heat the indoor space. The refrigerant condensed while passing through the indoor heat exchanger 5 may pass through the ninth pipe P9 and be expanded in the second expansion valve Vb up to a range corresponding to the medium pressure stage of the compressor 2. The medium pressure stage of the compressor 2 may be understood as a pressure formed between the pressure, that is, the low pressure, of the refrigerant flowing into the compressor 2 and the pressure, that is, the high pressure, of the refrigerant discharged from the compressor 2. For example, the second expansion valve Vb may be an electronic expansion valve EEV capable of adjusting the opening degree of the flow path of the ninth pipe P9.

The refrigerant expanded in the second expansion valve Vb may flow into the second gas-liquid separation pipe 11*b* in a two-phase state. Among two-phase refrigerant flowing into the second gas-liquid separation pipe 11*b*, a relatively large amount of gas refrigerant may flow into the gas-liquid separator 6 through the eighth pipe P8, and a relatively large amount of liquid refrigerant may flow into the gas-liquid separator 6 through the seventh pipe P7, which will be described hereinafter.

The gas-liquid separator 6 may separate and discharge the two-phase refrigerant introduced into the gas-liquid separator 6 into gas refrigerant and liquid refrigerant. The gas refrigerant separated in the gas-liquid separator 6 may flow into the medium pressure stage of the compressor 2 through the sixth pipe P6. In this case, the injection valve Vi may be an EEV or a solenoid valve that opens and closes the sixth pipe P6. The liquid refrigerant separated in the gas-liquid separator 6 may flow into the first gas-liquid separation pipe 11*a* through the fifth pipe P5. The liquid refrigerant introduced into the first gas-liquid separation pipe 11*a* may pass through the third pipe P3 and may expand in the first expansion valve Va up to a range corresponding to the low pressure stage of the compressor 2. For example, the first expansion valve Va may be an electronic expansion valve EEV capable of adjusting the opening degree of the flow path of the third pipe P3. The refrigerant expanded in the first expansion valve Va may flow into the outdoor heat exchanger 4 through the third pipe P3.

As the heat energy of outdoor air is transferred from the outdoor heat exchanger 4 to the refrigerant, the refrigerant may be evaporated. At this time, the outdoor heat exchanger 4 may be referred to as an evaporator. The refrigerant evaporated while passing through the outdoor heat exchanger 4 may flow into the accumulator 7 through the second pipe P2, the switching valve 3, and the eleventh pipe P11, sequentially, so that a refrigerant cycle for the above-described heating operation of the air conditioner may be completed.

Figure 2:
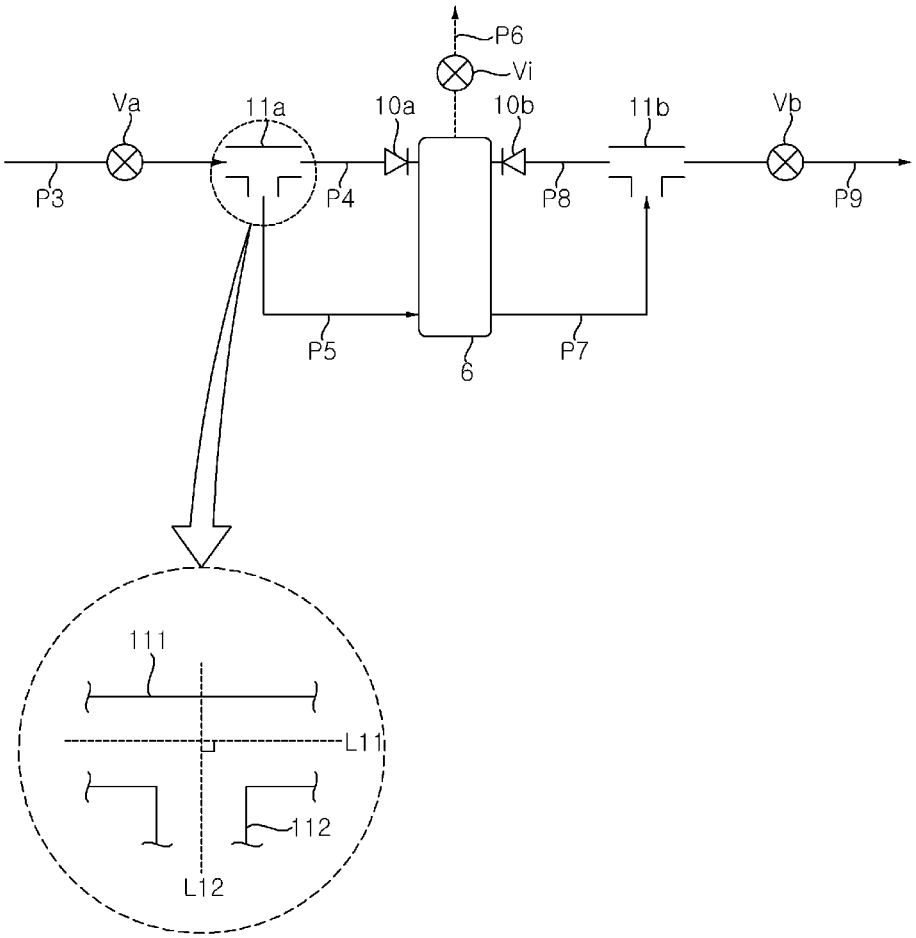
FIGS. 2 to 9 are diagrams showing examples of gas-liquid separation pipes of an air conditioner according to embodiments.

Referring to FIGS. 1 and 2, the refrigerant expanded in the first expansion valve Va may be first separated into gas refrigerant and liquid refrigerant in the first gas-liquid separation pipe 11*a*, and may be secondarily separated into gas refrigerant and liquid refrigerant in the gas-liquid separator 6. The refrigerant expanded in the second expansion valve Vb may be first separated into gas refrigerant and liquid refrigerant in the second gas-liquid separation pipe 11*b*, and may be secondarily separated into gas refrigerant and liquid refrigerant in the gas-liquid separator 6.

When the outdoor heat exchanger 4 serves as a condenser (refer to the left drawing of FIG. 1), the refrigerant that has passed through the outdoor heat exchanger 4 passes through the third pipe P3 and may be expanded in the first expansion valve Va. In this case, the refrigerant expanded in the first expansion valve Va may flow into the first gas-liquid separation pipe 11*a* through an inlet of the first gas-liquid separation pipe 11*a* connected to the third pipe P3. The third pipe P3 may be referred to as a "refrigerant inflow pipe". In addition, the refrigerant passing through the first gas-liquid separation pipe 11*a* may be introduced into the gas-liquid separator 6 through an outlet of the first gas-liquid separation pipe 11*a* connected to the fourth pipe P4 and the fifth pipe P5. The fourth pipe P4 and the fifth pipe P5 may be installed between the first gas-liquid separation pipe 11*a* and the gas-liquid separator 6, and may provide a flow path of refrigerant from the first gas-liquid separation pipe 11*a* to the gas-liquid separator 6. In this case, the fourth pipe P4 may be referred to as a "first refrigerant discharge pipe", and the fifth pipe P5 may be referred to as a "second refrigerant discharge pipe".

In addition, a first check valve 10*a* may be installed in the fourth pipe P4, so that the flow of the refrigerant passing through the fourth pipe P4 may be restricted to a direction from the outlet of the first gas-liquid separation pipe 11*a* toward the gas-liquid separator 6. Alternatively, a solenoid valve, instead of the first check valve 10*a*, may be installed in the fourth pipe P4.

In addition, the gas-liquid separator 6 may separate and discharge the refrigerant introduced through the fourth pipe P4 and the fifth pipe P5 into gas refrigerant and liquid refrigerant. That is, the gas refrigerant discharged from the gas-liquid separator 6 may be introduced into the medium pressure stage of the compressor 2 through the sixth pipe P6 opened and closed by the injection valve Vi. The liquid refrigerant discharged from the gas-liquid separator 6 may flow into an inlet of the second gas-liquid separation pipe 11*b* through the seventh pipe P7. The seventh pipe P7 may be installed between the gas-liquid separator 6 and the second gas-liquid separation pipe 11*b* to provide a flow path of refrigerant from the gas-liquid separator 6 to the second gas-liquid separation pipe 11*b*. In this case, the sixth pipe P6 may be referred to as a "gas refrigerant pipe", and the seventh pipe P7 may be referred to as a "liquid refrigerant pipe".

Further, the refrigerant passing through the second gas-liquid separation pipe 11*b* may pass through the ninth pipe P9 and be expanded in the second expansion valve Vb. In this case, the refrigerant expanded in the second expansion valve Vb may flow into the indoor heat exchanger 5 through the ninth pipe P9.

When the indoor heat exchanger 5 serves as a condenser (refer to the right drawing of FIG. 1), the refrigerant that has passed through the indoor heat exchanger 5 may pass through the ninth pipe P9 and be expanded in the second expansion valve Vb. In this case, the refrigerant expanded in the second expansion valve Vb may flow into the second gas-liquid separation pipe 11*b* through the inlet of the second gas-liquid separation pipe 11*b* connected to the ninth pipe P9. The ninth pipe P9 may be referred to as a "refrigerant inflow pipe". In addition, the refrigerant passing through the second gas-liquid separation pipe 11*b* may be introduced into the gas-liquid separator 6 through an outlet of the second gas-liquid separation pipe 11*b* connected to the seventh pipe P7 and the eighth pipe P8. The seventh pipe P7 and the eighth pipe P8 may be installed between the second gas-liquid separation pipe 11*b* and the gas-liquid separator 6, thereby providing a flow path for refrigerant from the second gas-liquid separation pipe 11*b* to the gas-liquid separator 6. In this case, the eighth pipe P8 may be referred to as a "first refrigerant discharge pipe", and the seventh pipe P7 may be referred to as a "second refrigerant discharge pipe".

In addition, a second check valve 10*b* may be installed in the eighth pipe P8, so that the flow of the refrigerant passing through the eighth pipe P8 may be restricted to a direction from the outlet of the second gas-liquid separation pipe 11*b* toward the gas-liquid separator 6. Alternatively, a solenoid valve, instead of the second check valve 10*b*, may be installed in the fourth pipe P4.

In addition, the gas-liquid separator 6 may separate and discharge the refrigerant introduced through the seventh pipe P7 and the eighth pipe P8 into gas refrigerant and liquid refrigerant. More specifically, the gas refrigerant discharged from the gas-liquid separator 6 may be introduced into the medium pressure stage of the compressor 2 through the sixth pipe P6 opened and closed by the injection valve Vi. The liquid refrigerant discharged from the gas-liquid separator 6 may flow into the inlet of the first gas-liquid separation pipe 11*a* through the fifth pipe P5. The fifth pipe P5 may be installed between the gas-liquid separator 6 and the first gas-liquid separation pipe 11*a*, thereby providing a flow path of refrigerant from the gas-liquid separator 6 to the first gas-liquid separation pipe 11*a*. In this case, the sixth pipe P6 may be referred to as a "gas refrigerant pipe", and the fifth pipe P5 may be referred to as a "liquid refrigerant pipe".

Further, the refrigerant passing through the first gas-liquid separation pipe 11*a* may pass through the third pipe P3 and be expanded in the first expansion valve Va. In this case, the refrigerant expanded in the first expansion valve Va may flow into the outdoor heat exchanger 4 through the third pipe P3.

The first gas-liquid separation pipe 11*a* and the second gas-liquid separation pipe 11*b* are common in that they provide a flow path for guiding the refrigerant expanded in the first expansion valve Va or the second expansion valve Vb to the gas-liquid separator 6, and a same structure may be applied to both pipes. Hereinafter, for brief description, in a case in which the outdoor heat exchanger 4 serves as a condenser (refer to the left drawing of FIG. 1), the first gas-liquid separation pipe 11*a* will be mainly described. A corresponding description may be applied to the description of the second gas-liquid separation pipe 11*b*, in a case in which the indoor heat exchanger 5 serves as a condenser (refer to the right drawing of FIG. 1).

The first gas-liquid separation pipe 11*a* may include a first part or portion 111 and a second part or portion 112. The first part 111 may extend lengthwise and be connected to the third pipe P3. The second part 112 may extend in a direction crossing a lengthwise direction of the first part 111 and may be coupled to the first part 111. For example, the first part 111 may extend horizontally along a virtual first extension line L11, and the second part 112 may extend vertically along a virtual second extension line L12 orthogonal to the first extension line L11.

One or a first end of the first part 111 may be connected to the third pipe P3, and the other or a second end of the first part 111 may be connected to the fourth pipe P4. One or a first end of the second part 112 may be formed between the first end and the second end of the first part 111 and formed below the first part 111, and the other or a second end of the second part 112 may be connected to the fifth pipe P5. For example, one or a first end of the fourth pipe P4 may be connected to the second end of the first part 111, and the other or a second end of the fourth pipe P4 may be horizontally connected to an upper side of the gas-liquid separator 6. For example, one or a first end of the fifth pipe P5 may be connected to the second end of the second part 112 and the other or a second end of the fifth pipe P5 may be horizontally connected to a lower side of the gas-liquid separator 6. Based on the gas-liquid separator 6, the seventh pipe P7 may be symmetrical with the fifth pipe P5, and the eighth pipe P8 may be symmetrical with the fourth pipe P4.

In this case, the flow of the liquid refrigerant among the two-phase refrigerant expanded in the first expansion valve Va and flowing into the first end of the first part 111 may be relatively more concentrated in the second end of the second part 112 than the second end of the first part 111. It can be understood that the liquid refrigerant is relatively more influenced by gravity than the gas refrigerant, so that the flow is concentrated in the second part 112 located below the first part 111. In contrast, the flow of the gas refrigerant among the two-phase refrigerant expanded in the first expansion valve Va and flowing into the first end of the first part 111 may be relatively more concentrated in the second end of the first part 111 than the second end of the second part 112.

Accordingly, the first gas-liquid separation pipe 11*a* may discharge a relatively larger amount of gas refrigerant, among the two-phase refrigerant flowing into the first gas-liquid separation pipe 11*a*, to the gas-liquid separator 6 through the fourth pipe P4, and may discharge a relatively larger amount of liquid refrigerant to the gas-liquid separator 6 through the fifth pipe P5. Thus, the gas-liquid separation efficiency in the gas-liquid separator 6 is increased, and reliability of the compressor may be obtained by preventing the liquid refrigerant from being discharged through the sixth pipe P6. In addition, it is easy to manage the level of the liquid refrigerant, so that performance or efficiency of the air conditioner may be improved.

Figure 3:
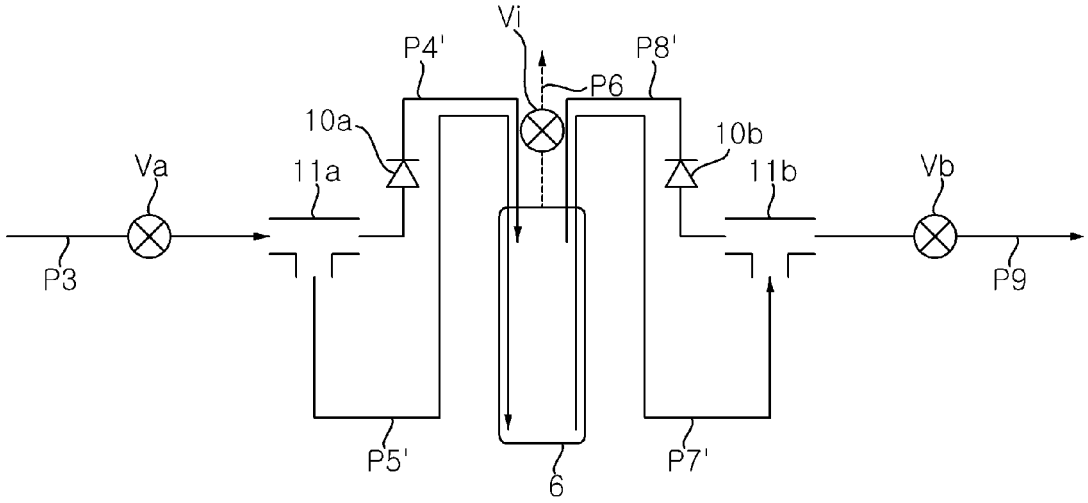

Referring to FIG. 3, one or a first end of fourth pipe P4' may be connected to the second end of the first part 111 (see FIG. 2), and the other or a second end of fourth pipe P4' may be vertically connected to the upper side of the gas-liquid separator 6. In this case, the first check valve 10*a* may be installed in the fourth pipe P4'. One or a first end of fifth pipe P5' may be connected to the second end of the second part 112 (see FIG. 2), and the other or a second end of fifth pipe P5' may be vertically connected to the lower side of the gas-liquid separator 6. Based on the gas-liquid separator 6, the seventh pipe P7' may be symmetrical with the fifth pipe P5', and the eighth pipe P8' may be symmetrical with the fourth pipe P4'.

Figure 4:
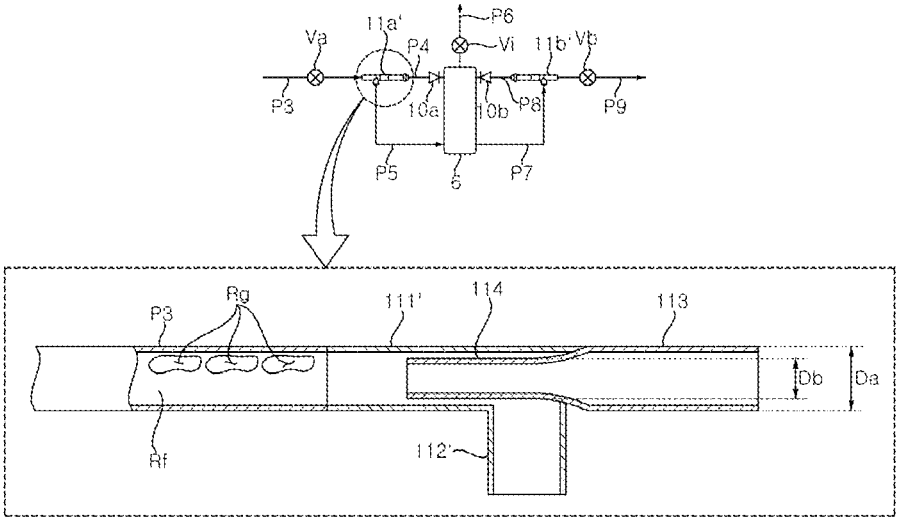

Referring to FIG. 4, first gas-liquid separation pipe 11*a*' may include a short tube 113, 114 in addition to first part 111' and second part 112'. One or a first end of the first part 111' may be connected to third pipe P3 and the other or a second end may be connected to the short tube 113, 114. One or a first end of the second part 112' may be formed between the first end and the other or a second end of the first part 111' and formed below the first part 111', and the other or a second end of the second part 112' may be connected to the fifth pipe P5.

One or a first end of the short tube 113, 114 may be disposed inside of the first part 111', and the other or a second end may be connected to the fourth pipe P4. More specifically, the short tube 113, 114 may include first tube 113 and second tube 114 having different diameters. A diameter Da of the first tube 113 may be larger than a diameter Db of the second tube 114. For example, the diameter Da of the first tube 113 may be the same as a diameter of the first part 111'. One or a first end of the second tube 114 may be disposed inside of the first part 111' while forming the first end of the short tube 113, 114, and may be positioned spaced apart from an inner surface of the first part 111'. The other or a second end of the second tube 114 may be connected to the first end of the first tube 113, and the second end of the first tube 113 may be connected to the fourth pipe P4 while forming the second end of the short tube 113, 114.

For example, the first tube 113 and the second tube 114 may be integrally formed. In this case, the short tube 113, 114 may be formed in a tapered shape a diameter of which decreases as it extends from the first tube 113 to the second tube 114.

A dryness of the two-phase refrigerant flowing through the third pipe P3 via the first expansion valve Va may be relatively low. For example, the dryness of the two-phase refrigerant flowing into the first gas-liquid separation pipe 11*a*' may be 0.4 or less. In this case, the gas refrigerant Rg among the refrigerant flowing through the third pipe P3 may exist in a bubble state in the phase of liquid refrigerant Rf. In other words, among the refrigerant flowing through the third pipe P3, the gas refrigerant Rg may flow while being spaced apart from an inner surface of the third pipe P3.

In this case, among the two-phase refrigerant expanded in the first expansion valve Va and flowing into the first end of the first part 111', the gas refrigerant may be easily introduced to the first end of the second tube 114 of the short tube 113, 114. In this case, the second part 112' may be overlapped with the second tube 114 in the vertical direction. In addition, among the two-phase refrigerant expanded in the first expansion valve Va and flowing into the first end of the first part 111', the liquid refrigerant may be easily introduced to the second part 112' along the inner surface of the first gas-liquid separation pipe 11*a*' due to fluid force.

Accordingly, performance of the first gas-liquid separation pipe 11*a*' for separating and discharging the two-phase refrigerant introduced into the first gas-liquid separation pipe 11*a*' into gas refrigerant and liquid refrigerant may be improved. Thus, the gas-liquid separation efficiency in the gas-liquid separator 6 may be increased, and reliability of the compressor may be obtained by preventing the liquid refrigerant from being discharged through the sixth pipe P6. In addition, it is easy to manage the level of the liquid refrigerant, so that performance or efficiency of the air conditioner may be improved.

Figure 5:
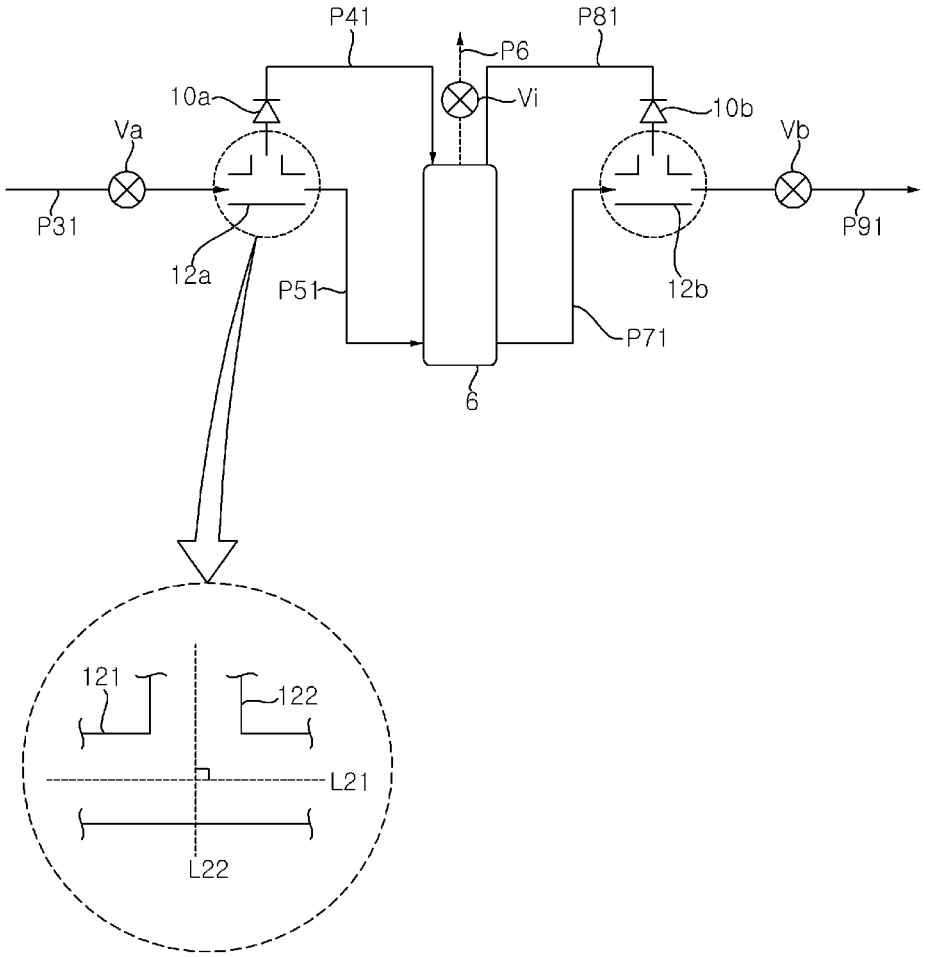

Referring to FIG. 5, the air conditioner 1 may include a first gas-liquid separation pipe 12*a* and a second gas-liquid separation pipe 12*b*. Hereinafter, for brief description, the first gas-liquid separation pipe 12*a* will be mainly described, and a corresponding description may be identically applied to the second gas-liquid separation pipe 12*b*.

The first gas-liquid separation pipe 12*a* may include a first part or portion 121 and a second part or portion 122. The first part 121 may extend lengthwise and may be connected to third pipe P31 in which the first expansion valve Va is installed. The third pipe P31 may be referred to as a "refrigerant inflow pipe". The second part 122 may extend in a direction crossing a lengthwise direction of the first part 121 and may be coupled to the first part 121. For example, the first part 121 may extend horizontally along a virtual first extension line L21, and the second part 122 may extend vertically along a virtual second extension line L22 orthogonal to the first extension line L21.

One or a first end of the first part 121 may be connected to the third pipe P31, and the other or a second end may be connected to fifth pipe P51. One or a first end of the second part 122 may be formed between the first end and the second end of the first part 121 and may be formed above the first part 121, and the other or a second end of the second part 122 may be connected to fourth pipe P41. The fourth pipe P41 may be referred to as a "first refrigerant discharge pipe", and the fifth pipe P51 may be referred to as a "second refrigerant discharge pipe". For example, one or a first end of the fourth pipe P41 may be connected to the second end of the second part 122, and the other or a second end of the fourth pipe P41 may be vertically connected to the upper side of the gas-liquid separator 6. For example, one or a first end of the fifth pipe P51 may be connected to the second end of the first part 121, and the other or a second end may be horizontally connected to the lower side of the gas-liquid separator 6. Based on the gas-liquid separator 6, seventh pipe P71 may be symmetrical with the fifth pipe P51, and eighth pipe P81 may be symmetrical with the fourth pipe P41.

In this case, the flow of the liquid refrigerant, among the two-phase refrigerant expanded in the first expansion valve Va and flowing into the first end of the first part 121, may be relatively more concentrated in the second end of the first part 121 than the second end of the second part 122. It can be understood that the liquid refrigerant is relatively influenced by gravity and inertial force than the gas refrigerant, so that the flow is concentrated in the first part 121 located below the second part 122. In contrast, the flow of the gas refrigerant, among the two-phase refrigerant expanded in the first expansion valve Va and flowing into the first end of the first part 121, may be relatively more concentrated in the second end of the second part 122 than the second end of the first part 121.

Accordingly, the first gas-liquid separation pipe 12*a* may discharge a relatively larger amount of gas refrigerant, among the two-phase refrigerant flowing into the first gas-liquid separation pipe 12*a*, to the gas-liquid separator 6 through the fourth pipe P4, and may discharge a relatively larger amount of liquid refrigerant to the gas-liquid separator 6 through the fifth pipe P51. Thus, a gas-liquid separation efficiency in the gas-liquid separator 6 may be increased, and reliability of the compressor may be obtained by preventing the liquid refrigerant from being discharged through the sixth pipe P6. In addition, it is easy to manage the level of the liquid refrigerant, so that performance or efficiency of the air conditioner may be improved.

Figure 6:
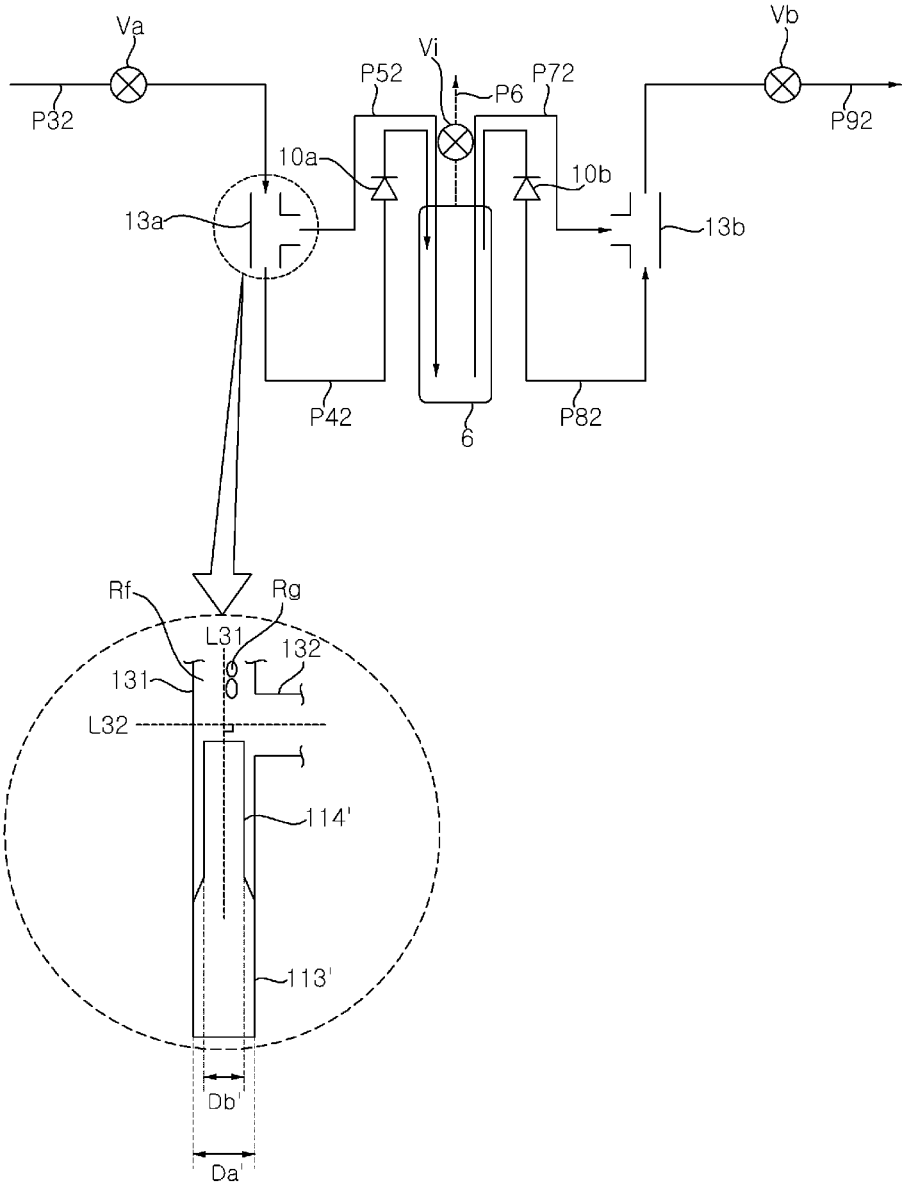

Referring to FIG. 6, the air conditioner 1 may include a first gas-liquid separation pipe 13*a* and a second gas-liquid separation pipe 13*b*. Hereinafter, for brief description, the first gas-liquid separation pipe 13*a* will be mainly described, and a corresponding description may be identically applied to the second gas-liquid separation pipe 13*b*.

The first gas-liquid separation pipe 13*a* may include a first part or portion 131 and a second part or portion 132. The first part 131 may extend and be connected to third pipe P32 in which the first expansion valve Va may be installed. The third pipe P32 may be referred to as a "refrigerant inflow pipe". The second part 132 may extend in a direction crossing a lengthwise direction of the first part 131 and may be coupled to the first part 131. For example, the first part 131 may extend vertically along a virtual first extension line L31, and the second part 132 may extend horizontally along a virtual second extension line L32 orthogonal to the first extension line L31.

One or a first end of the first part 131 may be connected to the third pipe P32, and the other or a second end may be connected to fourth pipe P42 in which the first check valve 10*a* may be installed. One or a first end of the second part 132 may be formed between the first end and the second end of the first part 131 and formed at a right or first lateral side of the first part 131, and the other or a second end of the second part 132 may be connected to fifth pipe P52. The fourth pipe P42 may be referred to as a "first refrigerant discharge pipe", and the fifth pipe P52 may be referred to as a "second refrigerant discharge pipe". For example, one or a first end of the fourth pipe P42 may be connected to the second end of the first part 131, and the second end of the fourth pipe P42 may be connected vertically to the upper portion of the gas-liquid separator 6. For example, one or a first end of the fifth pipe P52 may be connected to the second end of the second part 132, and the other or a second end may be vertically connected to the lower portion of the gas-liquid separator 6. Based on the gas-liquid separator 6, the seventh pipe P72 may be symmetrical with the fifth pipe P52, and the eighth pipe P82 may be symmetrical with the fourth pipe P42.

The first gas-liquid separation pipe 13*a* may include short tube 113', 114' in addition to the first part 131 and the second part 132. One or a first end of the short tube 113', 114' may be disposed inside the first part 131, and the other or a second end may be connected to the fourth pipe P42. More specifically, the short tube 113', 114' may include first tube 113' and second tube 114' having different diameters. A diameter Da' of the first tube 113' may be larger than a diameter Db' of the second tube 114'. For example, the diameter Da' of the first tube 113' may be the same as a diameter of the first part 131. One or a first end of the second tube 114' may be disposed inside the first part 131 while forming the first end of the short tube 113', 114', and may be positioned spaced apart from an inner surface of the first part 131. The other or a second end of the second tube 114' may be connected to the first end of the first tube 113', and the second end of the first tube 113' may be connected to the fourth pipe P42 while forming the second end of the short tube 113', 114'.

For example, the first tube 113' and the second tube 114' may be integrally formed. In this case, the short tube 113', 114' may have a tapered shape a diameter of which decreases as it extends from the first tube 113' to the second tube 114'.

The dryness of the two-phase refrigerant flowing through the third pipe P32 via the first expansion valve Va may be relatively low. For example, the dryness of the two-phase refrigerant flowing into the first gas-liquid separation pipe 13*a* may be 0.4 or less. In this case, the gas refrigerant Rg among the refrigerant flowing through the third pipe P32 may exist in a bubble state in the phase of liquid refrigerant Rf. In other words, among the refrigerant flowing through the third pipe P32, the gas refrigerant Rg may flow while being spaced apart from an inner surface of the third pipe P32.

In this case, among the two-phase refrigerant expanded in the first expansion valve Va and flowing into the first end of the first part 131, the gas refrigerant may be easily introduced to the first end of the second tube 114' of the short tube 113', 114'. In addition, among the two-phase refrigerant expanded in the first expansion valve Va and flowing into the first end of the first part 131, the liquid refrigerant may be easily introduced to the second part 132 along the inner surface of the first gas-liquid separation pipe 13*a* due to fluid force.

Accordingly, performance of the first gas-liquid separation pipe 13*a* for separating and discharging the two-phase refrigerant introduced into the first gas-liquid separation pipe 13*a* into gas refrigerant and liquid refrigerant may be improved. Thus, gas-liquid separation efficiency in the gas-liquid separator 6 may be increased, and reliability of the compressor may be obtained by preventing the liquid refrigerant from being discharged through the sixth pipe P6. In addition, it is easy to manage the level of the liquid refrigerant, so that performance or efficiency of the air conditioner may be improved.

Figure 7:
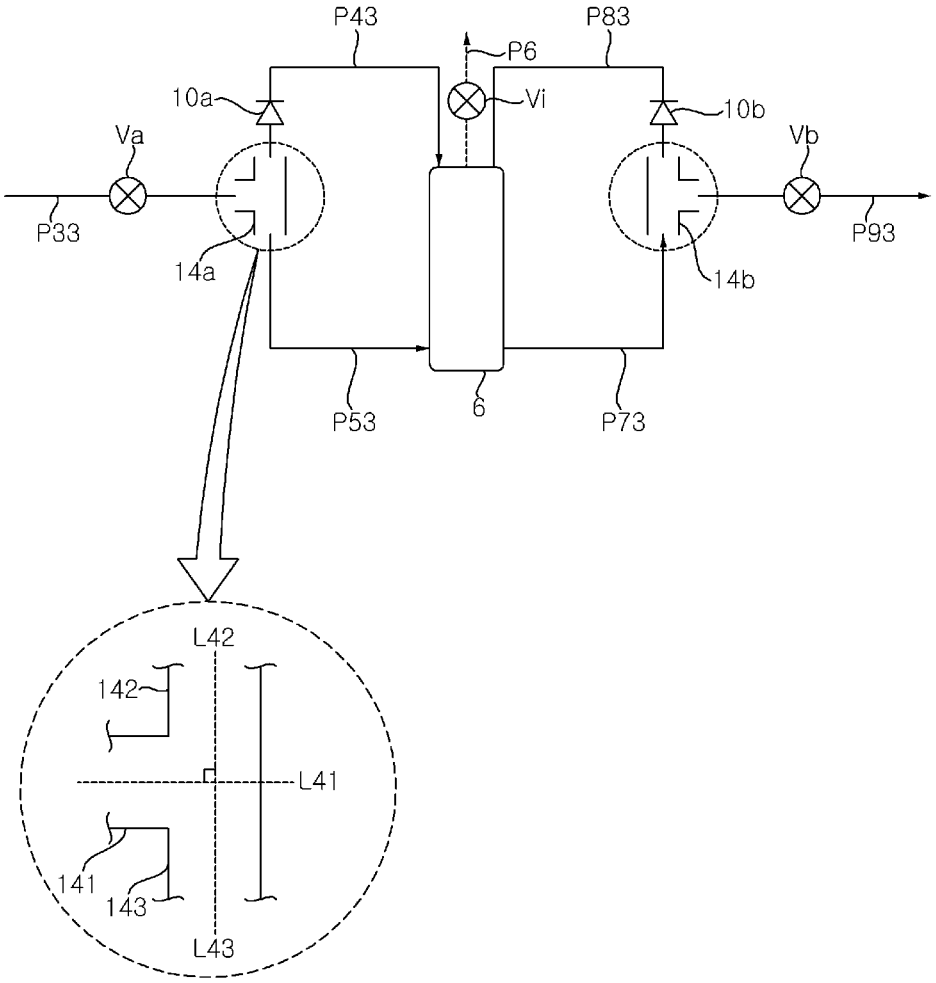

Referring to FIG. 7, the air conditioner 1 may include a first gas-liquid separation pipe 14*a* and a second gas-liquid separation pipe 14*b*. Hereinafter, for brief description, the first gas-liquid separation pipe 14*a* will be mainly described, and a corresponding description may be identically applied to the second gas-liquid separation pipe 14*b*.

The first gas-liquid separation pipe 14*a* may include a first part or portion 141 and a second part or portion 142, 143. The first part 141 may extend lengthwise and may be connected to third pipe P33 in which the first expansion valve Va may be installed. The third pipe P33 may be referred to as a "refrigerant inflow pipe". The second part 142, 143 may extend in a direction crossing a lengthwise direction of the first part 141 and may be coupled to the first part 141. For example, the first part 141 may extend horizontally along a virtual first extension line L41, and the second part 142, 143 may extend vertically along a virtual second extension line L42 or L43 orthogonal to the first extension line L41.

One or a first end of the first part 141 may be connected to the third pipe P33, and the other or a second end may be connected to the second part 142, 143. One or a first end of the second part 142, 143 may be connected to fourth pipe P43 in which the first check valve 10*a* may be installed, and the other or a second end of the second part 142, 143 may be connected to fifth pipe P53. The fourth pipe P43 may be referred to as a "first refrigerant discharge pipe", and the fifth pipe P51 may be referred to as a "second refrigerant discharge pipe". That is, the second end of the first part 141 may be formed between the first end and the second end of the second part 142, 143 and may be connected to a left or first lateral side of the second part 142, 143. In this case, the second part 142, 143 may include a second-first part or portion 142 which is positioned above the first part 141 while forming the first end of the second part 142, 143, and a second-second part or portion 143 which is positioned below the first part 141 while forming the second end of the second part 142, 143.

For example, one or a first end of the fourth pipe P43 may be connected to the second-first part 142, and the other or a second end of the fourth pipe P43 may be vertically connected to the upper side of the gas-liquid separator 6. For example, one or a first end of the fifth pipe P53 may be connected to the second-second part 143 and the other or a second end of the fifth pipe P53 may be horizontally connected to the lower side of the gas-liquid separator 6. Based on the gas-liquid separator 6, the seventh pipe P73 may be symmetrical with the fifth pipe P53, and the eighth pipe P83 may be symmetrical with the fourth pipe P43.

In this case, the flow of the liquid refrigerant, among the two-phase refrigerant expanded in the first expansion valve Va and flowing into the first end of the first part 141, may be relatively more concentrated in the second-second part 143 than the second-first part 142. It can be understood that the liquid refrigerant is more influenced by gravity than the gas refrigerant, so that the flow is concentrated in the second-second part 143 located below the second-first part 142. In contrast, the flow of the gas refrigerant, among the two-phase refrigerant expanded in the first expansion valve Va and flowing into the first end of the first part 141, may be relatively more concentrated in the second-first part 142 than the second-second part 143.

Accordingly, the first gas-liquid separation pipe 14*a* may discharge a relatively larger amount of gas refrigerant, among the two-phase refrigerant flowing into the first gas-liquid separation pipe 14*a*, to the gas-liquid separator 6 through the fourth pipe P43, and may discharge a relatively larger amount of liquid refrigerant to the gas-liquid separator 6 through the fifth pipe P53. Thus, gas-liquid separation efficiency in the gas-liquid separator 6 may be increased, and reliability of the compressor may be obtained by preventing the liquid refrigerant from being discharged through the sixth pipe P6. In addition, it is easy to manage the level of the liquid refrigerant, so that the performance or efficiency of the air conditioner may be improved.

Figure 8:
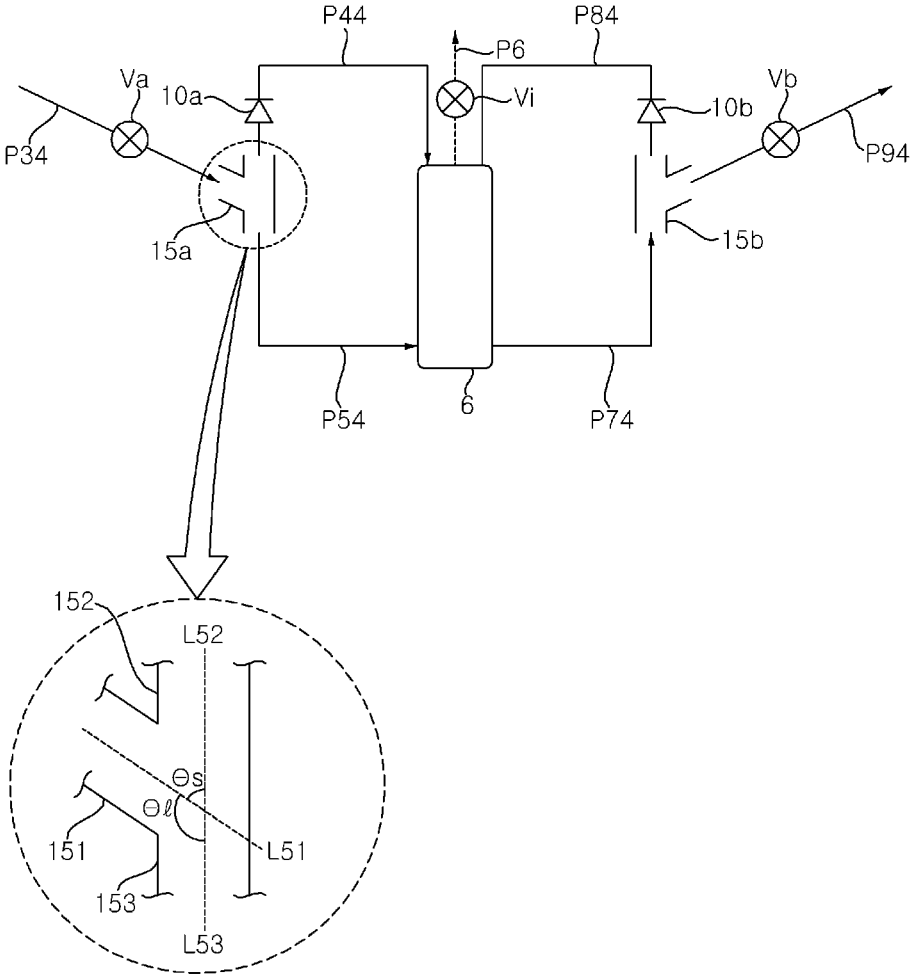

Referring to FIG. 8, the air conditioner 1 may include a first gas-liquid separation pipe 15*a* and a second gas-liquid separation pipe 15*b*. Hereinafter, for brief description, the first gas-liquid separation pipe 15*a* will be mainly described, and a corresponding description may be identically applied to the second gas-liquid separation pipe 15*b*.

The first gas-liquid separation pipe 15*a* may include a first part or portion 151 and a second part or portion 152, 153. The first part 131 may extend and be connected to third pipe P34 in which the first expansion valve Va may be installed. The third pipe P34 may be referred to as a "refrigerant inflow pipe". The second part 152, 153 may extend in a direction crossing a lengthwise direction of the first part 151 and be coupled to the first part 151. For example, the first part 151 may extend obliquely in a vertical direction along a virtual first extension line L51, and the second part 152, 153 may extend vertically along a virtual second extension line L52 or L53 crossing the first extension line L51.

One or a first end of the first part 151 may be connected to the third pipe P34 and the other or a second end may be connected to the second part 152, 153. One or a first end of the second part 152, 153 may be connected to fourth pipe P44 in which the first check valve 10*a* may be installed, and the other or a second end of the second part 152, 153 may be connected to fifth pipe P54. The fourth pipe P44 may be referred to as a "first refrigerant discharge pipe", and the fifth pipe P54 may be referred to as a "second refrigerant discharge pipe". That is, the second end of the first part 151 may be formed between the first end and the second end of the second part 152, 153 and may be connected to a left or first lateral side of the second part 152, 153. In this case, the second part 152, 153 may include a second-first part or portion 152 that forms an acute angle with the first part 151 while forming the first end of the second part 152, 153, and a second-second part 153 that forms an obtuse angle with the first part 151 while forming the second end of the second part 152, 153. In other words, the second-first part 152 may extend upwardly along the second-first extension line L52 forming an acute angle (es) with the first extension line L51, and the second-second part 153 may extend downwardly along the second-second extension line L53 forming an obtuse angle (81) with the first extension line L51.

For example, one or a first end of the fourth pipe P44 may be connected to the second-first part 152 and the other or a second end of the fourth pipe P44 may be vertically connected to the upper side of the gas-liquid separator 6. For example, one or a first end of the fifth pipe P54 may be connected to the second-second part 153, and the other or a second end of the fifth pipe P54 may be horizontally connected to the lower side of the gas-liquid separator 6. Based on the gas-liquid separator 6, the seventh pipe P74 may be symmetrical with the fifth pipe P54, and the eighth pipe P84 may be symmetrical with the fourth pipe P44.

In this case, the flow of the liquid refrigerant, among the two-phase refrigerant expanded in the first expansion valve Va and flowing into the first end of the first part 151, may be relatively more concentrated in the second-second part 153 than the second-first part 152. It can be understood that the liquid refrigerant is more influenced by gravity and inertial force than the gas refrigerant, so that the flow is concentrated in the second-second part 153 located below the second-first part 152. In contrast, the flow of the gas refrigerant, among the two-phase refrigerant expanded in the first expansion valve Va and flowing into the first end of the first part 151, may be relatively more concentrated in the second-first part 152 than the second-second part 153.

Accordingly, the first gas-liquid separation pipe 15*a* may discharge a relatively larger amount of gas refrigerant, among the two-phase refrigerant flowing into the first gas-liquid separation pipe 15*a*, to the gas-liquid separator 6 through the fourth pipe P44, and may discharge a relatively larger amount of liquid refrigerant to the gas-liquid separator 6 through the fifth pipe P54. Thus, gas-liquid separation efficiency in the gas-liquid separator 6 may be increased, and reliability of the compressor may be obtained by preventing the liquid refrigerant from being discharged through the sixth pipe P6. In addition, it is easy to manage the level of the liquid refrigerant, so that performance or efficiency of the air conditioner may be improved.

Figure 9:
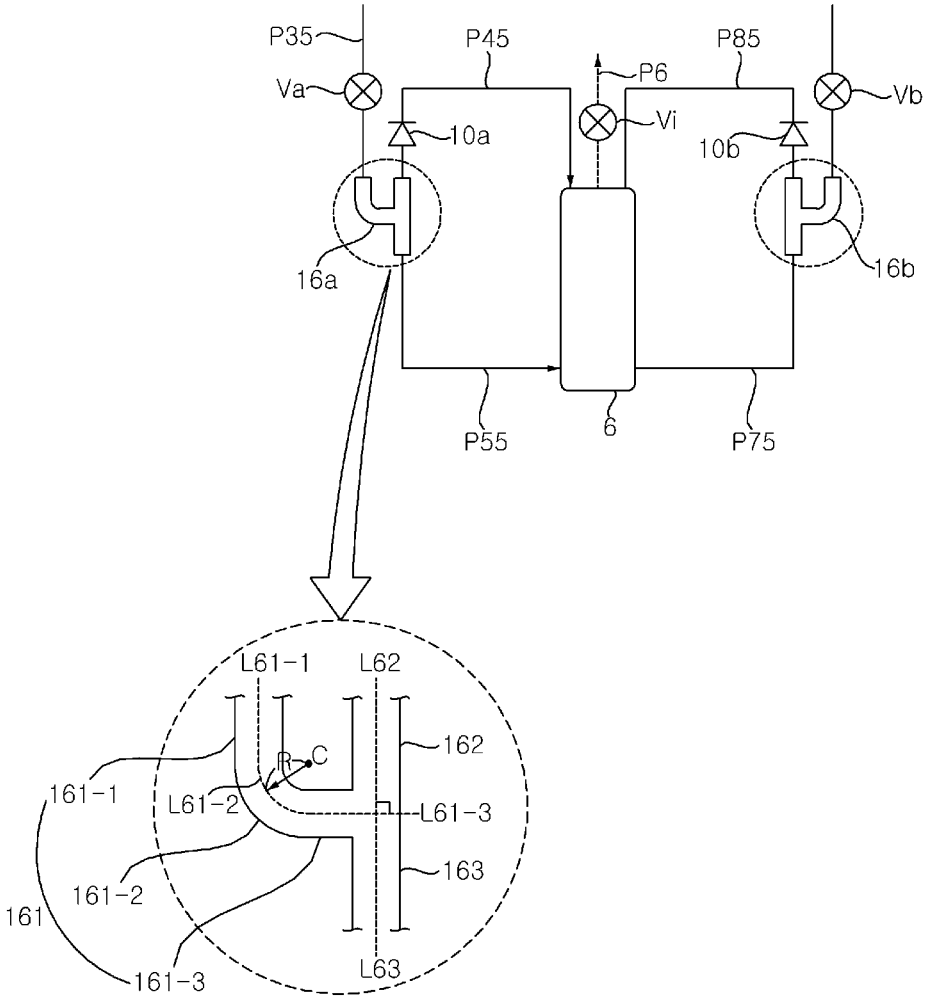

Referring to FIG. 9, the air conditioner 1 may include a first gas-liquid separation pipe 16*a* and a second gas-liquid separation pipe 16*b*. Hereinafter, for brief description, the first gas-liquid separation pipe 16*a* will be mainly described, and a corresponding description may be identically applied to the second gas-liquid separation pipe 16*b*.

The first gas-liquid separation pipe 16*a* may include a first part or portion 161 and a second part or portion 162, 163. The first part 161 may have a straight section and a curved section, and may be connected to third pipe P35 in which the first expansion valve Va may be installed. The third pipe P35 may be referred to as a "refrigerant inflow pipe". The second part 162, 163 may be coupled to the first part 151. For example, the first part 161 may include a first-first part 161-1, a first-second part 161-2, and a first-third part 161-3. In this case, the first-first part 161-1 may extend vertically along a virtual first-first extension line L61-1. In addition, the first-second part 161-2 may be connected to the first-first part 161-1, and may be formed to be curved along a virtual first-second line L61-2 having a constant radius of curvature R based on a center point C. In addition, the first-third part 161-3 may be connected to the first-second part 161-2, and may extend horizontally along a virtual first-third extension line L61-3. For example, the second part 162, 163 may extend vertically along a virtual second extension line L62 or L63 orthogonal to the third extension line L61-3.

One or a first end of the first part 161 may be connected to the third pipe P35, and the other or a second end may be connected to the second part 162, 163. One or a first end of the second part 162, 163 may be connected to fourth pipe P45 in which the first check valve 10*a* may be installed, and the other or a second end of the second part 162, 163 may be connected to fifth pipe P55. The fourth pipe P45 may be referred to as a "first refrigerant discharge pipe", and the fifth pipe P55 may be referred to as a "second refrigerant discharge pipe". That is, the second end of the first part 161 may be formed between the first end and the second end of the second part 162, 163, and may be connected to a left or first lateral side of the second part 162, 163. In this case, the second part 162, 163 may include a second-first part or portion 162 positioned above the first-third part 161-3 while forming the first end of the second part 162, 163, and a second-second part or portion 163 positioned below the first-third part 161-3 while forming the second end of the second part 162, 163.

For example, one or a first end of the fourth pipe P45 may be connected to the second-first part 162 and the other or a second end may be vertically connected to the upper side of the gas-liquid separator 6. For example, one or a first end of the fifth pipe P55 may be connected to the second-second part 163, and the other or a second end may be horizontally connected to the lower side of the gas-liquid separator 6. Based on the gas-liquid separator 6, the seventh pipe P75 may be symmetrical with the fifth pipe P55, and the eighth pipe P85 may be symmetrical with the fourth pipe P45.

In this case, the flow of the liquid refrigerant among the two-phase refrigerant expanded in the first expansion valve Va and flowing into the first end of the first part 161 may be relatively more concentrated in the second-second part 163 than the second-first part 162. It can be understood that the liquid refrigerant is more influenced by gravity and centrifugal force than the gas refrigerant, so that the flow is concentrated in the second-second part 163 located below the second-first part 162. In contrast, the flow of the gas refrigerant among the two-phase refrigerant expanded in the first expansion valve Va and flowing into the first end of the first part 161 may be relatively more concentrated in the second-first part 162 than the second-second part 163.

Accordingly, the first gas-liquid separation pipe 16*a* may discharge a relatively larger amount of gas refrigerant, among the two-phase refrigerant flowing into the first gas-liquid separation pipe 16*a*, to the gas-liquid separator 6 through the fourth pipe P45, and may discharge a relatively larger amount of liquid refrigerant to the gas-liquid separator 6 through the fifth pipe P55. Thus, gas-liquid separation efficiency in the gas-liquid separator 6 may be increased, and reliability of the compressor may be obtained by preventing the liquid refrigerant from being discharged through the sixth pipe P6. In addition, it is easy to manage the level of the liquid refrigerant, so that performance or efficiency of the air conditioner may be improved.

Figure 10:
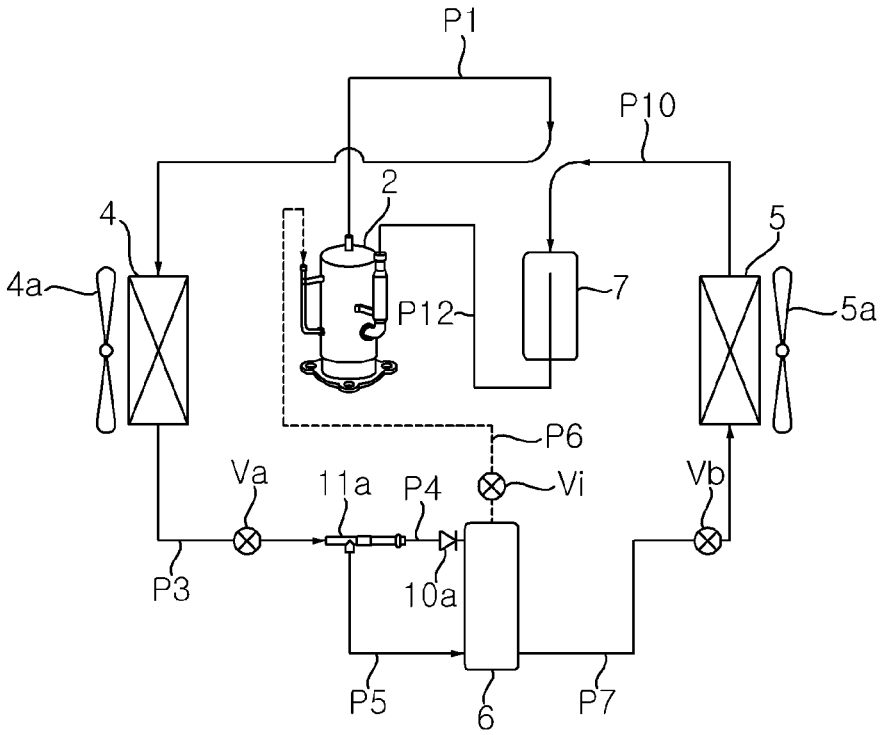
FIG. 10 is a schematic diagram of an air conditioner capable of performing a cooling operation or a heating operation according to an embodiment and a flow of a refrigerant, and explains an embodiment in which a single gas-liquid separation pipe is provided and gas refrigerant separated by a gas-liquid separator is injected into a medium pressure stage of a compressor.

Referring to FIG. 10, unlike the explanation described with reference to FIG. 1, for example, the air conditioner 1 may perform only one of a cooling operation and a heating operation. In this case, the air conditioner 1 may not be provided with the switching valve 3.

For example, the air conditioner 1 may perform only a cooling operation. In this case, the low-temperature and low-pressure refrigerant flowing from the accumulator 7 to the compressor 2 through the twelfth pipe P12 may be compressed in the compressor 2 and discharged in a high-temperature and high-pressure state. The refrigerant discharged from the compressor 2 may flow into the outdoor heat exchanger 4 through the first pipe P1. Here, the outdoor heat exchanger 4 may serve as a condenser.

The refrigerant condensed while passing through the outdoor heat exchanger 4 may pass through the third pipe P3 and may be expanded in the first expansion valve Va up to a range corresponding to the medium pressure stage of the compressor 2. The refrigerant expanded in the first expansion valve Va may flow into the gas-liquid separator 6 through the first gas-liquid separation pipe 11*a*, the fourth pipe P4, and the fifth pipe P5.

The gas-liquid separator 6 may separate and discharge the refrigerant introduced into the gas-liquid separator 6 into gas refrigerant and liquid refrigerant. The gas refrigerant separated by the gas-liquid separator 6 may be introduced into the medium pressure stage of the compressor 2 through the sixth pipe P6 in which the injection valve Vi may be installed. The liquid refrigerant separated in the gas-liquid separator 6 may pass through the seventh pipe P7 and may be expanded in the second expansion valve Vb up to a range corresponding to the low pressure stage of the compressor 2.

The refrigerant expanded in the second expansion valve Vb may flow into the indoor heat exchanger 5 through the seventh pipe P7. Here, the indoor heat exchanger 5 may serve as an evaporator. The refrigerant which is evaporated while passing through the indoor heat exchanger 5 may be introduced into the accumulator 7 through the tenth pipe P10, so that a refrigerant cycle for the above-described cooling operation of the air conditioner may be completed.

Figure 11:
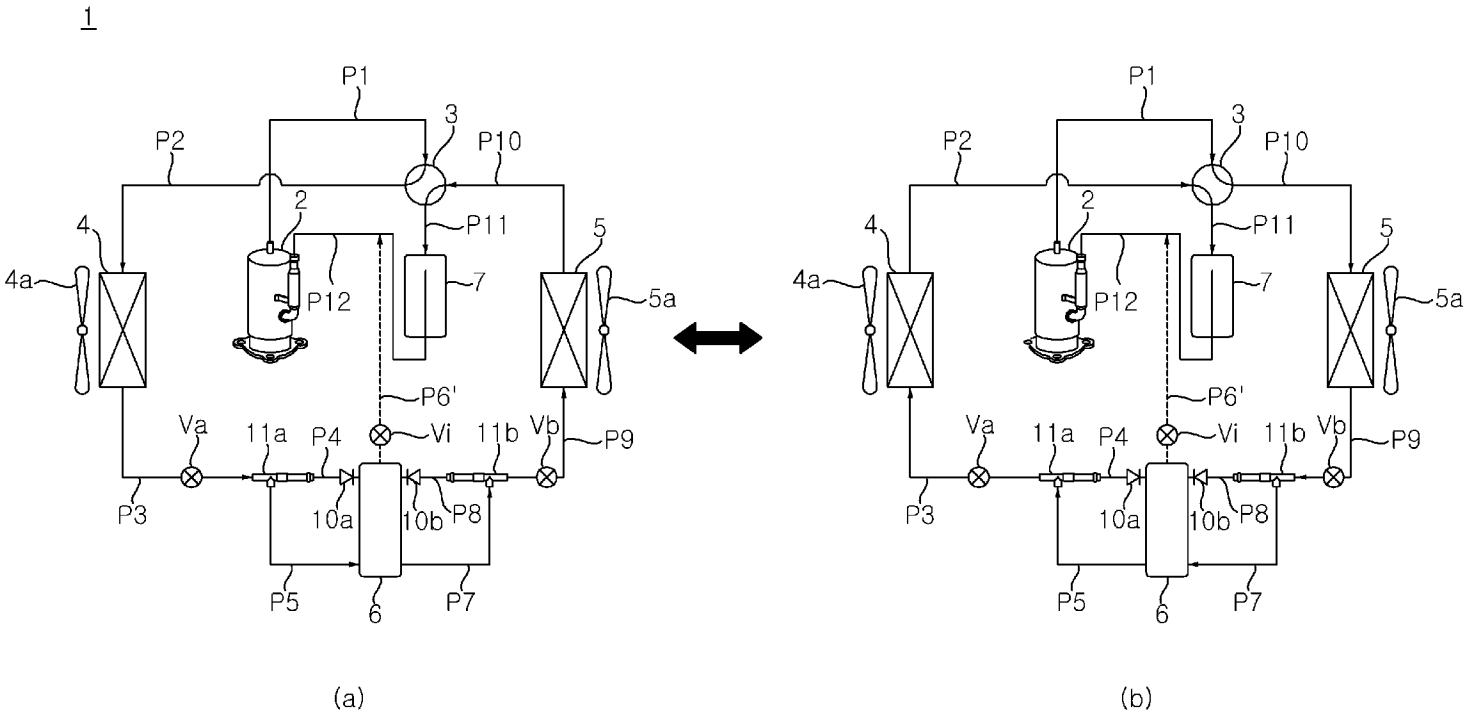
FIG. 11 is a schematic diagram of an air conditioner capable of switching between a cooling operation and a heating operation according to an embodiment and a flow of a refrigerant, and explains an embodiment in which a first gas-liquid separation pipe and a second gas-liquid separation pipe are provided and gas refrigerant separated by a gas-liquid separator is injected to a low pressure stage of a compressor.

Referring to FIG. 11, unlike the explanation described with reference to FIG. 1, for example, the gas refrigerant separated in the gas-liquid separator 6 may flow into the low pressure stage of the compressor 2 through the sixth pipe P6'. Referring to the left drawing of FIG. 11, for example, the air conditioner 1 may perform a cooling operation. In this case, the outdoor heat exchanger 4 may serve as a condenser, and the indoor heat exchanger 5 may serve as an evaporator.

The refrigerant which is condensed while passing through the outdoor heat exchanger 4 may pass through the third pipe P3 and may be expanded in the first expansion valve Va up to a range corresponding to the low pressure stage of the compressor 2. The refrigerant expanded in the first expansion valve Va may flow into the gas-liquid separator 6 through the first gas-liquid separation pipe 11*a*, the fourth pipe P4, and the fifth pipe P5.

The gas-liquid separator 6 may separate and discharge the refrigerant introduced into the gas-liquid separator 6 into gas refrigerant and liquid refrigerant. The gas refrigerant separated in the gas-liquid separator 6 may be introduced into the low pressure stage of the compressor 2 through the sixth pipe P6' in which the injection valve Vi is installed. One or a first end of the sixth pipe P6' may be connected to the gas-liquid separator 6, and the other or a second end may be connected to the twelfth pipe P12. The liquid refrigerant separated in the gas-liquid separator 6 may flow into the ninth pipe P9 through the seventh pipe P7 and the second gas-liquid separation pipe 11*b*.

The second expansion valve Vb opens the ninth pipe P9. The refrigerant may flow into the indoor heat exchanger 5 through the ninth pipe P9.

The refrigerant which is evaporated while passing through the indoor heat exchanger 5 may pass through the tenth pipe P10, the switching valve 3, and the eleventh pipe P11, sequentially, and may flow into the accumulator 7, so that a refrigerant cycle for the above-described cooling operation of air conditioner may be completed.

Referring to the right drawing of FIG. 11, for example, the air conditioner 1 may perform a heating operation. In this case, the indoor heat exchanger 5 may serve as a condenser, and the outdoor heat exchanger 4 may serve as an evaporator.

The refrigerant which is condensed while passing through the indoor heat exchanger 5 may pass through the ninth pipe P9 and may be expanded in the second expansion valve Vb up to a range corresponding to the low pressure stage of the compressor 2. The refrigerant expanded in the second expansion valve Vb may flow into the gas-liquid separator 6 through the second gas-liquid separation pipe 11*b*, the seventh pipe P7, and the eighth pipe P8.

The gas-liquid separator 6 may separate and discharge the refrigerant introduced into the gas-liquid separator 6 into gas refrigerant and liquid refrigerant. The gas refrigerant separated in the gas-liquid separator 6 may be introduced into the low pressure stage of the compressor 2 through the sixth pipe P6' in which the injection valve Vi may be installed. The liquid refrigerant separated in the gas-liquid separator 6 may flow into the third pipe P3 through the fifth pipe P5 and the first gas-liquid separation pipe 11*a*.

The first expansion valve Va opens the third pipe P3. The refrigerant may flow into the outdoor heat exchanger 4 through the third pipe P3.

The refrigerant which is evaporated while passing through the outdoor heat exchanger 4 may pass through the second pipe P2, the switching valve 3, and the eleventh pipe P11, sequentially, to flow into the accumulator 7, so that a refrigerant cycle for the above-described heating operation of air conditioner can be completed.

Figure 12:
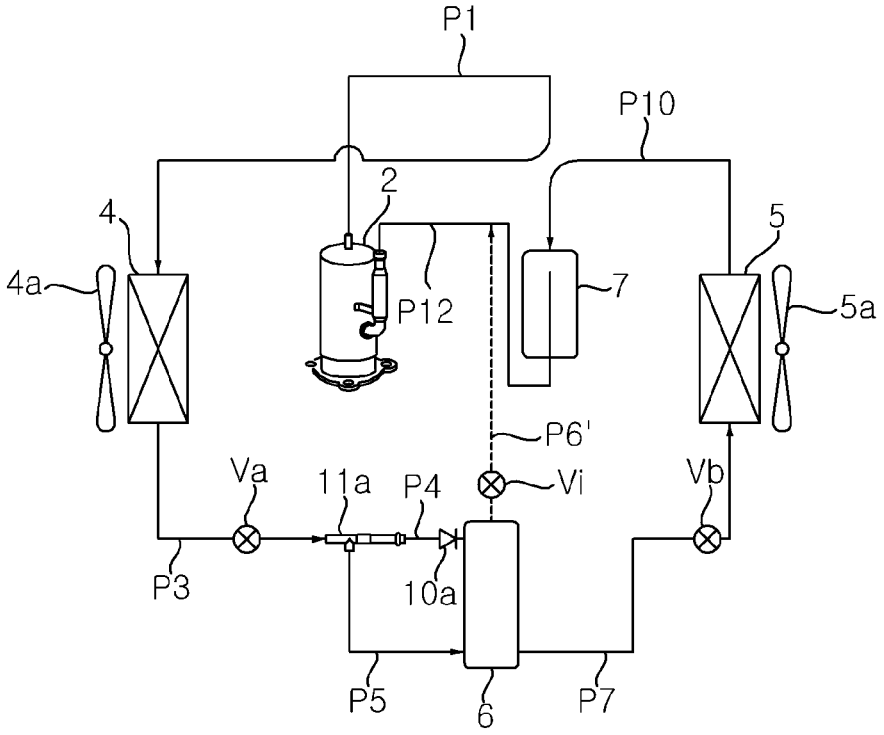
FIG. 12 is a schematic diagram of an air conditioner capable of performing a cooling operation or a heating operation according to an embodiment and a flow of a refrigerant, and explains an embodiment in which a single gas-liquid separation pipe is provided and gas refrigerant separated by a gas-liquid separator is injected to a low pressure stage of a compressor.

Referring to FIG. 12, unlike the explanation described with reference to FIG. 11, the air conditioner 1 may perform only one of a cooling operation and a heating operation. In this case, the air conditioner 1 may not be provided with the switching valve 3.

For example, the air conditioner 1 may perform only a cooling operation. In this case, the low-temperature and low-pressure refrigerant flowing from the accumulator 7 to the compressor 2 through the twelfth pipe P12 may be compressed in the compressor 2 and discharged in a high-temperature and high-pressure state. The refrigerant discharged from the compressor 2 may flow into the outdoor heat exchanger 4 through the first pipe P1. Here, the outdoor heat exchanger 4 may serve as a condenser.

The refrigerant which is condensed while passing through the outdoor heat exchanger 4 may pass through the third pipe P3 and may be expanded in the first expansion valve Va up to a range corresponding to the low pressure stage of the compressor 2. The refrigerant expanded in the first expansion valve Va may flow into the gas-liquid separator 6 through the first gas-liquid separation pipe 11*a*, the fourth pipe P4, and the fifth pipe P5.

The gas-liquid separator 6 may separate and discharge the refrigerant introduced into the gas-liquid separator 6 into gas refrigerant and liquid refrigerant. The gas refrigerant separated in the gas-liquid separator 6 may be introduced into the low pressure stage of the compressor 2 through the sixth pipe P6' in which the injection valve Vi is installed. The liquid refrigerant separated in the gas-liquid separator 6 may flow into the indoor heat exchanger 5 through the seventh pipe P7 opened by the second expansion valve Vb. The indoor heat exchanger 5 may serve as an evaporator. The refrigerant which is evaporated while passing through the indoor heat exchanger 5 may be introduced into the accumulator 7 through the tenth pipe P10, so that a refrigerant cycle for the above-described cooling operation of air conditioner may be completed.

According to embodiments disclosed herein, an air conditioner is provided that may include a compressor that compresses a refrigerant; a condenser that condenses the refrigerant discharged from the compressor; an expansion valve that expands the refrigerant passed through the condenser; a gas-liquid separation pipe through which the refrigerant passed through the expansion valve flows; a gas-liquid separator, into which the refrigerant passed through the gas-liquid separation pipe is introduced, that separates and discharges the refrigerant introduced into the gas-liquid separator into gas refrigerant and liquid refrigerant; and an evaporator that evaporates the liquid refrigerant discharged from the gas-liquid separator. The gas refrigerant discharged from the gas-liquid separator and the refrigerant passed through the evaporator may be provided to the compressor. The gas-liquid separation pipe may include a first part or portion that extends lengthwise, and is connected to a refrigerant inflow pipe in which the expansion valve may be installed, and a second part or portion that extends in a direction crossing a lengthwise direction of the first part and is coupled to the first part. At least one of the first part or the second part may be connected to the gas-liquid separator. One or a first end of the first part may be connected to the refrigerant inflow pipe, and one or a first end of the second part may be coupled to a lower side of the first part between the one end and the other or a second end of the first part.

The air conditioner may further include a first refrigerant discharge pipe installed between the other end of the first part and the gas-liquid separator, and a second refrigerant discharge pipe installed between the other or a second end of the second part and the gas-liquid separator. The first part may extend in a horizontal direction, and the second part may extend in a vertical direction.

The air conditioner may further include a short tube having one or a first end disposed inside of the first part and the other or a second end connected to the first refrigerant discharge pipe. The short tube may include a first tube that forms the other end of the short tube and has a first diameter, and a second tube that forms one or a first end of the short tube and has a second diameter smaller than the first diameter.

The second tube may be located spaced apart from an inner surface of the first part. The second part may overlap the second tube in a vertical direction.

One end of the first part may be connected to the refrigerant inflow pipe. One end of the second part may be coupled to an upper side of the first part between one end and the other end of the first part.

The air conditioner may further include a first refrigerant discharge pipe installed between the other end of the second part and the gas-liquid separator, and a second refrigerant discharge pipe installed between the other end of the first part and the gas-liquid separator. The first part may extend in a horizontal direction, and the second part may extend in a vertical direction.

One end of the first part may be connected to the refrigerant inflow pipe. One end of the second part may be coupled to one side of the first part between one end and the other end of the first part.

The air conditioner may further include a first refrigerant discharge pipe installed between the other end of the first part and the gas-liquid separator; a second refrigerant discharge pipe installed between the other end of the second part and the gas-liquid separator; and a short tube having one end disposed inside the first part and the other end connected to the first refrigerant discharge pipe. The first part may extend in a vertical direction, and the second part may extend in a horizontal direction. The short tube may include a first tube that forms the other end of the short tube and has a first diameter, and a second tube that forms one end of the short tube and has a second diameter smaller than the first diameter.

One end of the first part may be connected to the refrigerant inflow pipe. The other end of the first part may be coupled to one side of the second part between one end and the other end of the second part.

The air conditioner may further include a first refrigerant discharge pipe installed between one end of the second part and the gas-liquid separator, and a second refrigerant discharge pipe installed between the other end of the second part and the gas-liquid separator. The first part may extend in a horizontal direction, the second part may extend in a vertical direction, and one end of the second part may be located above the other end of the second part.

The air conditioner may further include a first refrigerant discharge pipe installed between one end of the second part and the gas-liquid separator, and a second refrigerant discharge pipe installed between the other end of the second part and the gas-liquid separator. The first part may extend in a direction at an incline to a vertical direction, the second part may extend in the vertical direction, and one end of the second part may be located above the other end of the second part.

The air conditioner may further include a first refrigerant discharge pipe installed between one end of the second part and the gas-liquid separator, and a second refrigerant discharge pipe installed between the other end of the second part and the gas-liquid separator. The first part further may include a first-first part that forms one end of the first part and extends in a vertical direction; a first-second part connected to the first-first part and having a constant curvature; and a first-third part connected to the first-second part, forming the other end of the first part, and extending in a horizontal direction. The second part may extend in the vertical direction, and one end of the second part may be located above the other end of the second part.

The expansion valve may further include a first expansion valve installed between the condenser and the gas-liquid separator, and a second expansion valve installed between the evaporator and the gas-liquid separator. The gas-liquid separation pipe may further include a first gas-liquid separation pipe installed between the first expansion valve and the gas-liquid separator, and a second gas-liquid separation pipe installed between the second expansion valve and the gas-liquid separator.

The air conditioner may further include a liquid refrigerant pipe, installed between the gas-liquid separator and the evaporator, through which the liquid refrigerant separated in the gas-liquid separator flows; a gas refrigerant pipe, installed between the gas-liquid separator and the compressor, through which the gas refrigerant separated in the gas-liquid separator flows; and an injection valve installed in the gas refrigerant pipe.

Embodiments disclosed herein have at least the following advantages.

According to embodiments disclosed herein, it is possible to provide an air conditioner capable of increasing a separation rate of gas refrigerant and liquid refrigerant by providing a gas-liquid separation pipe at a front end of a gas-liquid separator. According to embodiments disclosed herein, it is possible to provide an air conditioner capable of securing reliability of a compressor by preventing liquid refrigerant from being discharged into a gas-liquid refrigerant pipe of a gas-liquid separator. Also, according to embodiments disclosed herein, it is possible to provide various embodiments of a structure of gas-liquid separation pipe.

Embodiments disclosed herein solve the above and other problems.

Embodiments disclosed herein provide an air conditioner capable of increasing a separation rate of gas refrigerant and liquid refrigerant by providing a gas-liquid separation pipe at a front end of a gas-liquid separator. Embodiments disclosed herein further provide an air conditioner capable of securing reliability of a compressor by preventing liquid refrigerant from being discharged into a gas-liquid refrigerant pipe of a gas-liquid separator. Embodiments disclosed herein furthermore provide various embodiments of a structure of gas-liquid separation pipe.

In accordance with embodiments disclosed herein, an air conditioner is provided that may include: a compressor that compresses a refrigerant; a condenser that condenses the refrigerant discharged from the compressor; an expansion valve that expands the refrigerant passed through the condenser; a gas-liquid separation pipe through which the refrigerant passed through the expansion valve flows; a gas-liquid separator, through which the refrigerant passed through the gas-liquid separation pipe is introduced, that separates and discharges the refrigerant introduced into the gas-liquid separator into gas refrigerant and liquid refrigerant; and an evaporator that evaporates the liquid refrigerant discharged from the gas-liquid separator. The gas refrigerant discharged from the gas-liquid separator and the refrigerant passed through the evaporator may be provided to the compressor, and the gas-liquid separation pipe may include a first part or portion that extends long or lengthwise, and is connected to a refrigerant inflow pipe in which the expansion valve may be installed, and a second part or portion that extends in a direction crossing a lengthwise direction of the first part and is coupled to the first part. At least one of the first part or the second part may be connected to the gas-liquid separator.

Although exemplary embodiments have been disclosed for illustrative purposes, those skilled in the art will appreciate that various modifications, additions and substitutions are possible, without departing from the scope and spirit as disclosed in the accompanying claims. Accordingly, the scope is not construed as being limited to the described embodiments but is defined by the appended claims as well as equivalents thereto.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor that compresses a refrigerant;

a condenser that condenses the refrigerant discharged from the compressor;

at least one expansion valve that expands the refrigerant passed through the condenser;

at least one pipe through which the refrigerant passed through the expansion valve flows;

a gas-liquid separator, to which the refrigerant passed through the at least one pipe is introduced, that separates and discharges the refrigerant introduced into the gas-liquid separator as gas refrigerant and liquid refrigerant; and an evaporator that evaporates the liquid refrigerant discharged from the gas-liquid separator, wherein the gas refrigerant discharged from the gas-liquid separator and the refrigerant passed through the evaporator are provided to the compressor, and the at least one pipe comprises:

a first portion that extends lengthwise, and is connected to a refrigerant inflow pipe in which the at least one expansion valve is installed; and a second portion that extends in a direction crossing a lengthwise direction of the first portion and is coupled to the first portion, wherein at least one of the first portion or the second portion is connected to the gas-liquid separator, wherein a first end of the first portion is connected to the refrigerant inflow pipe, and wherein a first end of the second portion is coupled to one side of the first portion the first end and a second of portion between the first end and a second end of the second portion.

2. The air conditioner of claim 1, wherein the first end of the second portion is coupled to a lower side of the first portion between the first end and the second end of the first portion.

3. The air conditioner of claim 2, further comprising:

a first refrigerant discharge pipe which is disposed between the second end of the first portion and the gas-liquid separator; and a second refrigerant discharge pipe disposed between the second end of the second portion and the gas-liquid separator, wherein the first portion extends in a horizontal direction, and the second portion extends in a vertical direction.

4. The air conditioner of claim 3, further comprising a short tube having a first end disposed inside the first portion and a second end connected to the first refrigerant discharge pipe, wherein the short tube comprises:

a first tube that forms the second end of the short tube and having a first diameter; and a second tube that forms the first end of the short tube and having a second diameter smaller than the first diameter.

5. The air conditioner of claim 4, wherein the second tube is spaced apart from an inner surface of the first portion, and the second portion overlaps the second tube in the vertical direction.

6. The air conditioner of claim 1, wherein the first end of the second portion is coupled to an upper side of the first portion between the first end and a second end of the first portion.

7. The air conditioner of claim 6, further comprising:

a first refrigerant discharge pipe installed between the second end of the second portion and the gas-liquid separator; and a second refrigerant discharge pipe installed between the second end of the first portion and the gas-liquid separator, wherein the first portion extends in a horizontal direction, and the second portion extends in a vertical direction.

8. The air conditioner of claim 1, wherein the first end of the second portion is coupled to the one side of the first portion between the first end and the second end of the first portion, wherein the air conditioner further comprises:

a first refrigerant discharge pipe installed between the second end of the first portion and the gas-liquid separator;

a second refrigerant discharge pipe installed between the second end of the second portion and the gas-liquid separator; and a short tube having a first end disposed inside of the first portion and a second end connected to the first refrigerant discharge pipe, wherein the first portion extends in a vertical direction, and the second portion extends in a horizontal direction, and wherein the short tube comprises:

a first tube that forms the second end of the short tube and having a first diameter; and a second tube that forms the first end of the short tube and having a second diameter smaller than the first diameter.

9. The air conditioner of claim 1, wherein the second end of the first portion is coupled to the one side of the second portion between the first end and the second end of the second portion, wherein the air conditioner further comprises:

a first refrigerant discharge pipe installed between the first end of the second portion and the gas-liquid separator; and a second refrigerant discharge pipe installed between the second end of the second portion and the gas-liquid separator, and wherein the first portion extends in a horizontal direction, the second portion extends in a vertical direction, and the first end of the second portion is located above the second end of the second portion.

10. The air conditioner of claim 1, wherein the second end of the first portion is coupled to the one side of the second portion between the first end and the second end the second portion, wherein the air conditioner further comprises:

a first refrigerant discharge pipe installed between the first end of the second portion and the gas-liquid separator; and a second refrigerant discharge pipe installed between the second end of the second portion and the gas-liquid separator, and wherein the first portion extends in a direction inclined to a vertical direction, the second portion extends in the vertical direction, and the first end of the second portion is located above the second end of the second portion.

11. The air conditioner of claim 1, wherein the second end of die first portion is coupled to the one side of the second portion between the first end and the second end of the second portion, wherein the air conditioner further comprises:

a first refrigerant discharge pipe disposed between the first end of the second portion and the gas-liquid separator; and a second refrigerant discharge pipe disposed between the second end of the second portion and the gas-liquid separator, wherein the first portion further comprises:

a first-first portion that forms the first end of the first portion, and extends in a vertical direction;

a first-second portion that is connected to the first-first portion, and has a constant curvature; and a first-third portion which is connected to the first-second portion, forms the second end of the first portion, and extends in a horizontal direction, wherein the second portion extends in the vertical direction, and wherein the second end of the second portion is located above the second end of the second portion.

12. The air conditioner of claim 1, wherein the at least one expansion valve comprises:

a first expansion valve disposed between the condenser and the gas-liquid separator; and a second expansion valve disposed between the evaporator and the gas-liquid separator, and wherein the at least one pipe further comprises:

a first pipe disposed between the first expansion valve and the gas-liquid separator; and a second pipe disposed between the second expansion valve and the gas-liquid separator.

13. The air conditioner of claim 1, further comprising:

a liquid refrigerant pipe, which is disposed between the gas-liquid separator and the evaporator, through which the liquid refrigerant separated in the gas-liquid separator flows;

a gas refrigerant pipe, which is disposed between the gas-liquid separator and the compressor, through which the gas refrigerant separated in the gas-liquid separator flows; and an injection valve disposed in the gas refrigerant pipe.

14. An air conditioner, comprising:

a compressor that compresses a refrigerant;

a condenser that condenses the refrigerant discharged from the compressor;

a plurality of expansion valves that expands the refrigerant;

a plurality of pipes through which the refrigerant passed through the plurality of expansion valves flows;

a gas-liquid separator, to which the refrigerant passed through the plurality of pipes is introduced, that separates and discharges the refrigerant introduced into the gas-liquid separator as gas refrigerant and liquid refrigerant; and an evaporator that evaporates the liquid refrigerant discharged from the gas-liquid separator, wherein the gas refrigerant discharged from the gas-liquid separator and the refrigerant passed through the evaporator are provided to the compressor, wherein the plurality of expansion valves comprises:

a first expansion valve disposed between the condenser and the gas-liquid separator; and a second expansion valve disposed between the evaporator and the gas-liquid separator, wherein the plurality of pipes comprises:

a first pipe disposed between the first expansion valve and the gas-liquid separator; and a second pipe disposed between the second expansion valve and the gas-liquid separator, and wherein each of the plurality of pipes comprises:

a first portion that extends lengthwise, and is connected to a refrigerant inflow pipe in which the at least one expansion valve is installed; and a second portion that extends in a direction crossing a lengthwise direction of the first portion and is coupled to the first portion.

15. The air conditioner of claim 14, further comprising:

a liquid refrigerant pipe, which is disposed between the gas-liquid separator and the evaporator, through which the liquid refrigerant separated in the gas-liquid separator flows;

a gas refrigerant pipe, which is disposed between the gas-liquid separator and the compressor, through which the gas refrigerant separated in the gas-liquid separator flows; and an injection valve disposed in the gas refrigerant pipe.

16. An air conditioner, comprising:

a compressor that compresses a refrigerant;

a condenser that condenses the refrigerant discharged from the compressor;

at least one expansion valve that expands the refrigerant passed through the condenser;

at least one pipe through which the refrigerant passed through the expansion valve flows;

a gas-liquid separator, to which the refrigerant passed through the at least one pipe is introduced, that separates and discharges the refrigerant introduced into the gas-liquid separator as gas refrigerant and liquid refrigerant; and an evaporator that evaporates the liquid refrigerant discharged from the gas-liquid separator, wherein the gas refrigerant discharged from the gas-liquid separator and the refrigerant passed through the evaporator are provided to the compressor, and the at least one pipe comprises:

a first portion connected to a refrigerant inflow pipe in which the at least one expansion valve is installed;

a second portion that extends in a direction crossing a lengthwise direction of the first portion and is coupled to the first portion, wherein at least one of the first portion or the second portion is connected to the gas-liquid separator; and a short tube having a first end disposed inside the first portion and a second end connected to a refrigerant discharge pipe, wherein the short tube comprises:

a first tube that forms the second end of the short tube and having a first diameter; and a second tube that forms the first end of the short tube and having a second diameter smaller than the first diameter.

17. The air conditioner of claim 16, wherein the second tube is spaced apart from an inner surface of the first portion, and the second portion overlaps the second tube.

18. The air conditioner of claim 16, further comprising:

a liquid refrigerant pipe, which is disposed between the gas-liquid separator and the evaporator, through which the liquid refrigerant separated in the gas-liquid separator flows;

a gas refrigerant pipe, which is disposed between the gas-liquid separator and the compressor, through which the gas refrigerant separated in the gas-liquid separator flows; and an injection valve disposed in the gas refrigerant pipe.

* * * * *